United States Patent [19]

Cromer et al.

[11] 4,044,211

[45] Aug. 23, 1977

[54] PUFFER-TYPE COMPRESSED-GAS CIRCUIT-INTERRUPTER

[75] Inventors: Charles F. Cromer, Trafford; Willie B. Freeman, Monroeville, both of Pa.

[73] Assignee: Westinghouse Electric Corporation, Pittsburgh, Pa.

[21] Appl. No.: 602,705

[22] Filed: Aug. 7, 1975

[51] Int. Cl.[2] ..... H01H 33/88

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 3,786,215 | 1/1974 | Mauthe | 200/148 A |
| 3,906,180 | 9/1975 | Glarner | 200/148 A |
| 3,909,572 | 9/1975 | Tsubaki et al. | 200/148 A |
| 3,941,962 | 3/1976 | Thaler | 200/148 A |
| 3,955,057 | 5/1976 | Dabringhausen et al. | 200/148 A |

*Primary Examiner*—Robert S. Macon
*Attorney, Agent, or Firm*—W. R. Crout

[57] ABSTRACT

An improved puffer-type gas-blast circuit-interrupter is provided having a movable operating cylinder assembly movable over a relatively-fixed piston structure. A high-compression ratio is obtained during the opening operation by minimizing the "dead" volume of arc-quenching gas within the movable operating cylinder, and an efficient gas-flow path through the movable cylinder assembly smoothly converges through the movable nozzle throat area into the drawn arc.

The improved puffer-type interrupter of the present invention, additionally, is provided with a shorter insulating nozzle than in conventional "puffers" to provide a more efficient gas path; and finally, a continuous annular stationary piston configuration requires no orientation procedures for assembly operations.

8 Claims, 6 Drawing Figures

22
48
40
32
7
30
54
40
40
48
27
32
24

L1
4
1
3
42
33
46
6
36
48
42
44
48
54
32
II
II
7
24a
40
40
32
50
27
30
22
28
26a
24
2
26
9
52
CLOSED POSITION 20
10
L2
19
18
17
13
16
14
12

INITIAL ARCING POSITION

FULLY OPEN POSITION

PUFFER-TYPE COMPRESSED-GAS CIRCUIT-INTERRUPTER

CROSS-REFERENCES TO RELATED APPLICATIONS

Reference may be made to United States patent application filed May 12, 1975, Ser. No. 576,820 now U.S. Pat. No. 3,987,262 issued Oct. 19, 1976 to Joseph Rostron, entitled "Puffer-Type Gas-Blast Circuit- Interrupter Having Variable-Area Stationary Composite Piston Structure". Additionally, reference may also be made to United States patent application filed September 25, 1975 by Joseph Rostron et al Ser. No. 616,703, entitled "Improved Puffer- Type Compressed-Gas Circuit-Interrupter", both of said patent applications being assigned to the assignee of the instant patent application.

BACKGROUND OF THE INVENTION

The present invention is particularly related to puffer-type compressed-gas circuit-interrupters of the type in which only a single pressure is utilized within the interrupting structure, and a difference of pressure for arc interruption is achieved by piston action, that is, relative movement of an operating cylinder to a piston structure. Attention may be directed to United States patents: 3,839,613 — Tsubaki et al; 3,602,670 - Calvino Teijeiro; 3,849,616 — Calvino Teijeiro; 3,670,124 — Calvino Teijeiro; 3,670,125 — Calvino Teijeiro; and 3,712,969 — Calvino Teijeiro.

As well known by those skilled in the art, the relative motion between the movable operating cylinder assembly and the fixed piston achieves a desirable compression of gas within the compression chamber, which compressed gas is utilized during arc interruption by generally forcing the compressed high-pressure gas through a movable nozzle structure to direct the high-pressure gas flow intimately into engagement with the established arc within the movable nozzle to effect the latter's extinction.

DESCRIPTION OF THE PRIOR ART

The present invention relates to puffer-type circuit-interrupters of the type set forth in U.S. Pat. No. 3,551,623, issued Dec. 29, 1970, to Robert G. Colclaser, Jr. and William H. Fischer. This patent shows the relative motion of a movable piston within a relatively stationary operating cylinder, with electromagnetic coils energizing a companion movable piston, which is electrically repelled toward the first-mentioned movable piston, the latter being attached to, and movable with, a contact-operating rod.

As well known by those skilled in the art, there are many patents treating different piston structures, for example, U.S. Pat. No. 2,429,311, issued Oct. 21, 1947, to M. J. Gay; and U.S. Pat. No. 3,786,215, issued Jan. 15, 1974 to Gerhard Mauphe.

An additional patent of interest in connection with piston structures is U.S. Pat. No. 3,331,935, issued July 18, 1967 to Stanislaw A. Milianowicz. Another piston patent, utilizing hydraulic action for effecting piston action, is U.S. Pat. No. 2,913,559, issued Nov. 17, 1959, to Charles F. Cromer.

An additional patent of interest is German Pat. No. 671,326 patented in Germany October 1937. All of the aforesaid patents indicate that piston structures of the prior art are well known, but many have deficiencies of complexity and of being rather slow in operation. In addition, back pressure gas conditions may easily arise, which renders the interrupter, as a whole, relatively slow-acting in operation, generally taking perhaps 8 cycles to effect circuit interruption.

BRIEF SUMMARY OF THE INVENTION

An improved puffer-type gas-blast circuit-interrupter is provided having a relatively stationary contact structure cooperable with a movable contact structure, the latter being affixed to, and movable with, a movable operating cylinder assembly. The movable operating cylinder assembly moves, or operatively slides, over a relatively-fixed composite piston structure.

A high gas-compression ratio is obtained so that upon the completion of the opening stroke of the movable operating cylinder assembly there is a minimization of the "dead" volume, or compression space available for arcquenching gas, this giving rise to the improved high-pressure gas-flow conditions through the relatively-short insulating movable nozzle, through which the extablished arc is drawn.

Another feature of the present invention is the provision of an improved efficient gas-flow path through the movable cylinder assembly smoothly converging into the restricted nozzle throat area.

Still another important feature of the present invention is the provision of a continuous annular fixed piston portion requiring thereby no special orientation thereof in the assembly operations of the circuit-interrupter.

DESCRIPTION OF THE PREFERRED EMBODIMENTS

Figures 1, 2:
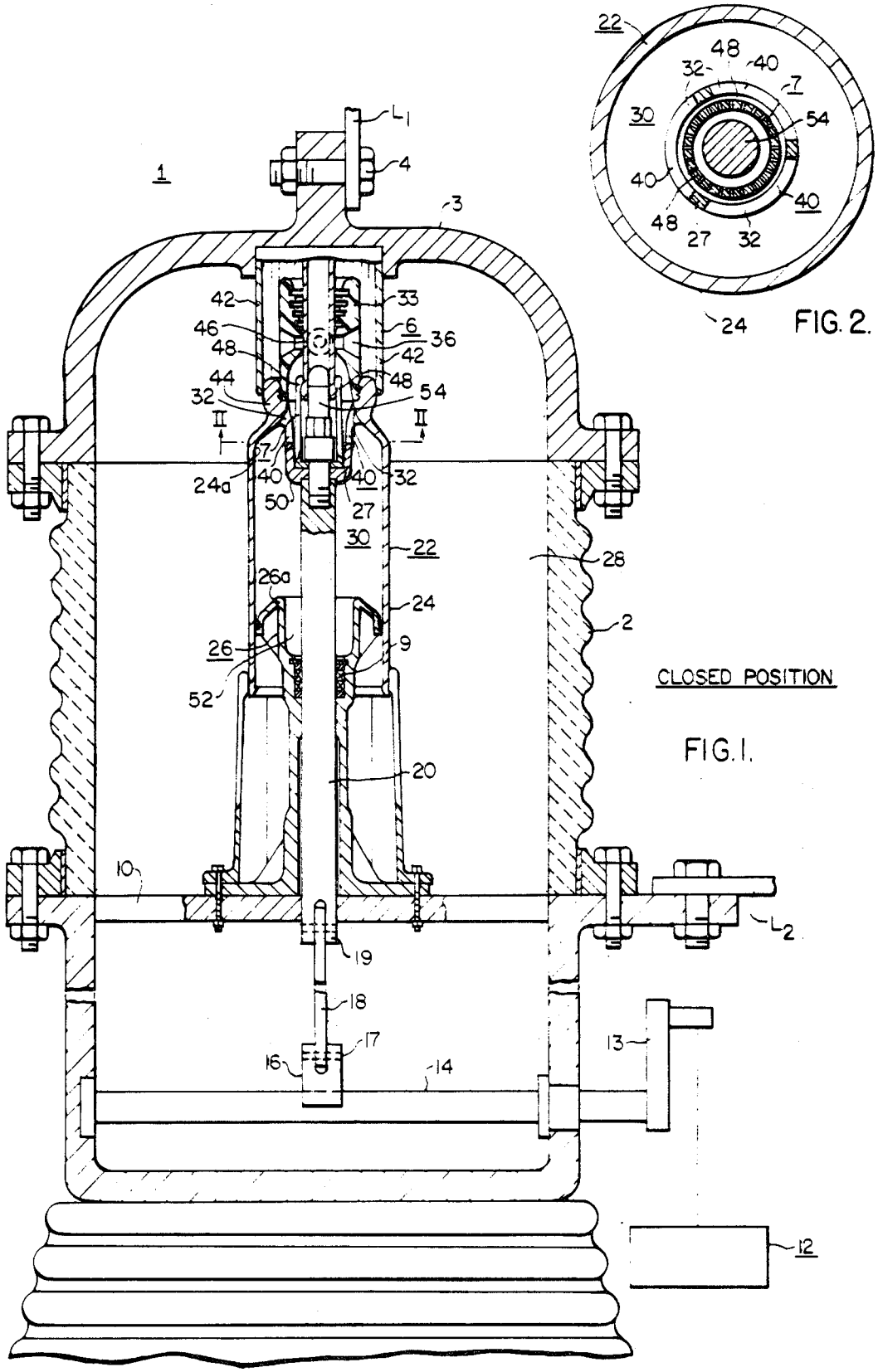
FIG. 1 is a vertical sectional view taken through one embodiment of the present invention illustrating a gas-blast puffer-type circuit-interrupter with the separable contacts illustrated in the closed-circuit position.
FIG. 2 is a detailed enlarge sectional view taken substantially along the line II—II of FIG. 1 looking in the direction of the arrows.

Referring to the drawings, and more particularly to FIGS. 1–4 thereof, it will be observed that there is provided a puffer-type compressed-gas circuit-interrupter 1 having an upstanding insulating casing structure 2, which is provided at its upper end with a metallic dome-shaped conducting cap portion 3, the latter supporting, by means of a bolt 4, a line-terminal connection $L_1$. Extending downwardly interiorly of the conducting dome-shaped casting 3 within the casing 2 is a relatively stationary contact structure, designated by the reference numeral 6, and cooperable in the closed-circuit position with a movable contact structure 7, as illustrated more clearly in FIG. 1 of the drawings. The movable contact structure 7 is electrically connected, by a plurality of sliding ring contacts 9, to a generally horizontally-extending conducting support plate 10, which provides a second line terminal $L_2$ externally of the casing 2, as again shown more clearly in FIG. 1.

A suitable operating mechanism 12 of conventional form effects rotation of an externally-provided crank-arm 13, the latter effecting opening and closing rotative motions of an internally-disposed operating shaft 14. The operating shaft 14, in turn, is fixedly connected to an internally disposed rotative crank-arm 16, which is pivotally connected, as at 17, to a floating link 18, the latter being pivotally connected, as at 19, to the lower end of a linearly-movable contact operating rod 20.

It will be noted that the upper end of the contact operating rod 20 forms the movable contact 7 itself, which, as mentioned heretofore, makes contacting closed-circuit engagement with the stationary contact structure 6 in the closed-circuit position of the interrupting device 1, as illustrated in FIG. 1.

A movable operating cylinder assembly 22 is provided having a large-diameter, downwardly-extending movable sleeve portion 24, which slidably moves over a relatively fixed piston structure 26, as again illustrated in FIG. 1.

Figure 3:
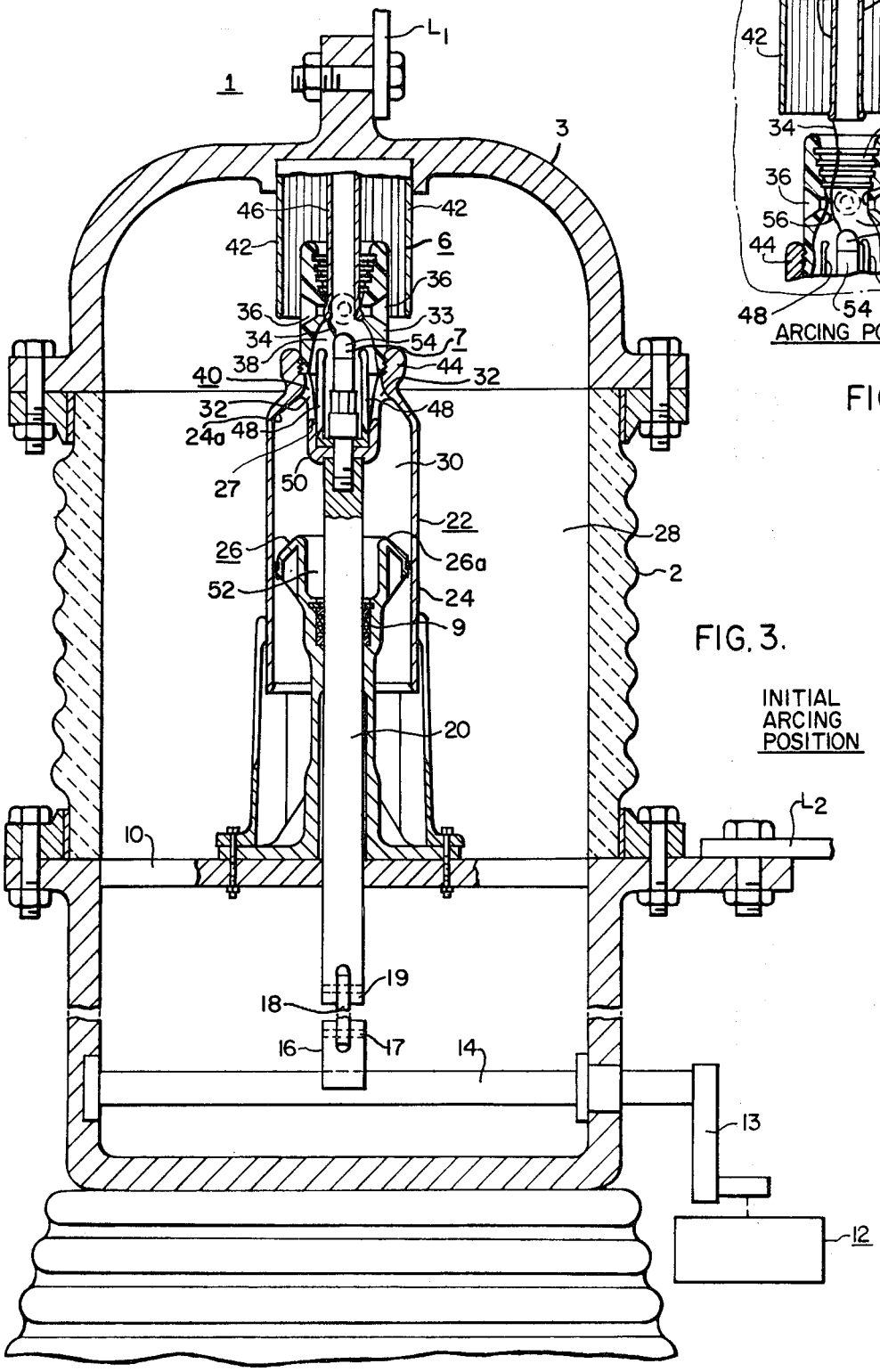
FIG. 3 is a view similar to FIG. 1, but illustrating the disposition of the several component parts in the partially-open-circuit position of the circuit-interrupter in the early stages of arcing.
Figure 4:
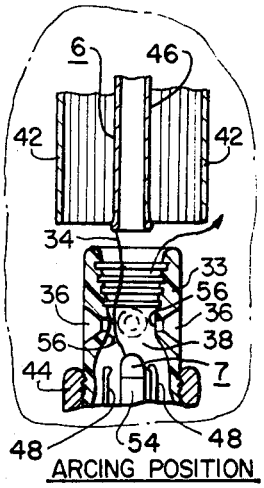
FIG. 4 is a fragmentary sectional view illustrating a later stage of arcing than the FIG. 3 position.
Figures 5, 6:
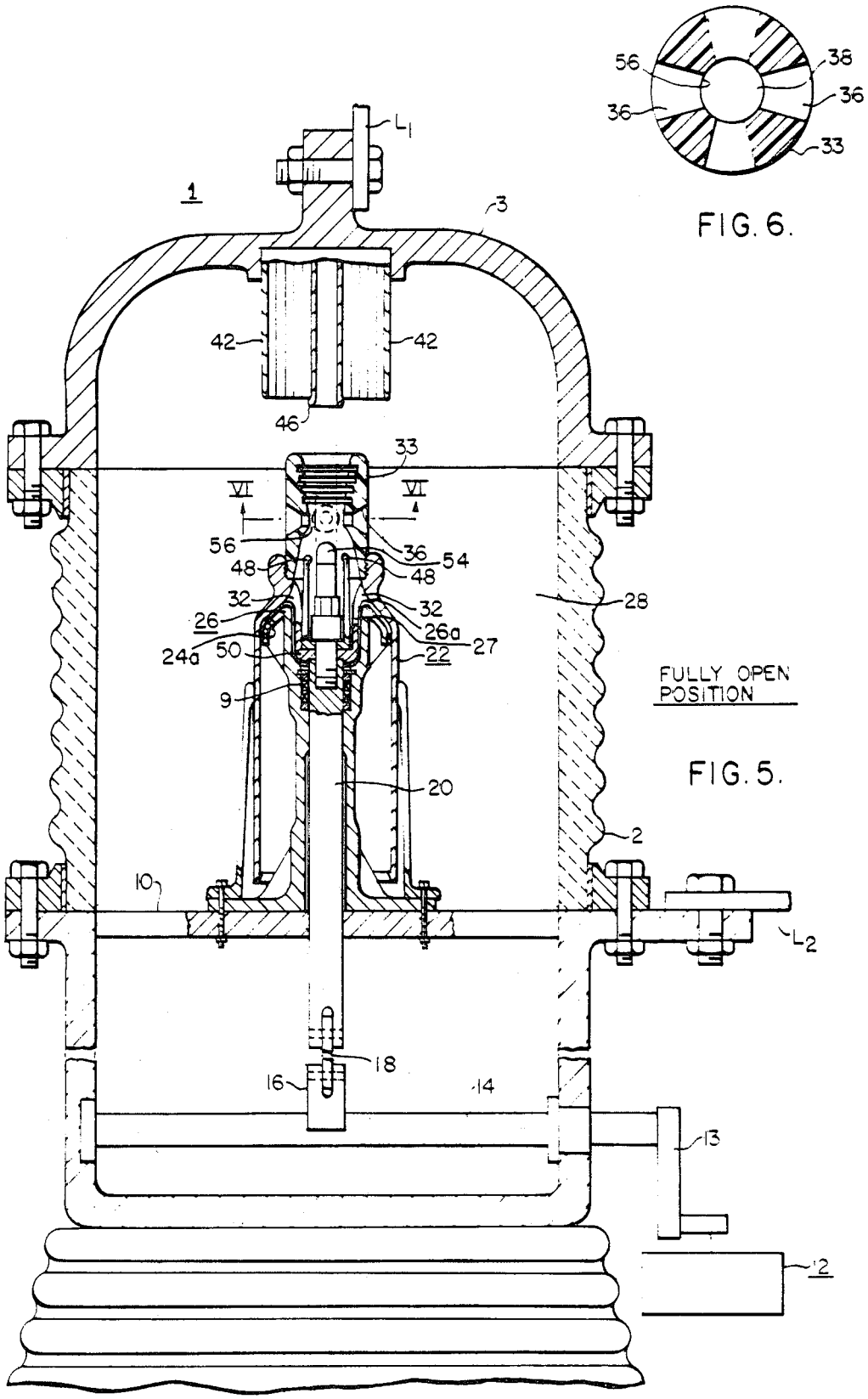
FIG. 5 illustrates the circuit-interrupter in the fully-open-circuit position; and, FIG. 6 is a fragmentary enlarged sectional view taken along the line VI—VI of FIG. 5.

During the opening operation, it will be observed that the movable operating cylinder 22 moves downwardly over the relatively fixed piston structure 26 compressing gas 28 within the region 30, and forcing it to flow upwardly through the vent openings 32 and through the relatively short nozzle 33, through which the arc 34 is drawn, as shown in FIGS. 3 and 4.

With reference to the nozzle 33, it will be observed that there is provided a plurality, say in this particular instance four, vent openings 36 to enable the hot arc gases to quickly vent from the arcing region 38 to thereby enable a desirable cooling action to take place. Reference may be made to United States Telford Pat. No. 3,291,948 issued Dec. 13, 1966 in this connection.

FIG. 2 more clearly shows a sectional view taken through the movable operating cylinder 22, indicating the wide venting area 40 provided by the vent openings 32 to provide unimpeded flow of high-pressure gas 28 from the compression area 30 within the movable operating cylinder 22 upwardly through the vent openings 32 and into the movable nozzle structure 33, where arc-extinction quickly takes place.

The stationary main contact fingers 42 make contacting engagement in the closed-circuit position, as illustrated in FIG. 1, with an annular main movable contact portion 44. During the opening operation of the puffer interrupter 1, the main stationary contact fingers 42 part company with the annular movable main contacting portion 44, so that thereafter contact is only maintained between the stationary tubular arching contact 46 and movable arcing contact fingers 48, as illustrated in FIG. 1.

Downward continued opening motion of the conducting operating rod 20, as effected to the operating mechanism 12, continues to force the movable operating cylinder 22 downwardly over the stationary piston structure 26, thereby providing an upward flow of compressed gas through the movable nozzle 33. It will be observed that a downwardly- extending movable boss portion 50 enters a stationary cavity 52 provided generally centrally of the relatively-fixed piston structure 26 and thereby provides a mating closing interengagement between the two cooperation structures to thereby minimize the "dead" volume of gas within the space 30. This is desirable inasmuch as a higher gas-compression ratio is thereby achieved.

During the closing operation of the puffer interrupter 1, the movable operating cylinder 22 moves upwardly and carries with it the annular main movable contact 44 together with the movable arcing fingers 48. First an interengagement is made between the tubular stationary arcing contact 46 and the cluster of movable arcing fingers 48. This contacting interengagement prevents a subsequent prestriking condition occurring between the main stationary contact fingers 42 and the main annular contact portion 44. Thus, there is no arcing occurring or permitted whatsoever at the main stationary contact fingers 42 and the annular main movable contact 44, all pre-arching 34 being confined to the stationary tubular arcing contact 46 and the movable arcing contact probe 54 to prevent arc erosion occurring at the main contacts during the closing operation.

The gas-flow path through the movable operating cylinder 22 and the movable insulating nozzle 33 presents an efficiently-shaped contour, with steadily decreasing gas-flow area 40 reaching the minimum, or critical flow area only at the nozzle throat 56.

The shorter nozzle 33 allows the stationary contact 46 to clear the gas-exit flow area 56 at a shorter opening stroke of the puffer interrupter moving contact assembly 7. This provides a shorter minimum interrupting time, since it is necessary to clear hot gas from the arcing region 38 to develop dielectric strength between the contacts 46 and 54. The nozzle length should be short enough to clear contact 46 from the nozzle's downstream exit 56 at the point in travel in which sufficient gas pressure has been developed by the compression stroke of movable operating cylinder 22.

More specifically, these two conditions must occur for one interruption:

1. Sufficient pressure to provide the minimum flow rate of SF6 which will extinguish the arc 34.

2. Sufficient exit area 56 to provide the minimum flow rate of SF6 which will extinguish the arc 34.

The optimum performance i.e. minimum arcing timing will be achieved when both conditions (1) and (2) occur simultaneously.

In conventional puffer type interrupters the minimum arcing time generally occurs with the stationary contact 46 well inside the nozzle 33. Such devices will generally be improved by expanding the downstream nozzle more rapidly and/or by shortening the nozzle. The latter is more effective.

However, the nozzle must not be shortened to clear the stationary contact before sufficient pressure has been developed by the compression stroke. If this is done, the pressure rise will be delayed and thus the minimum interrupting time delayed. At the end of the opening stroke, the annular section **26*a* of the stationary piston 26 extends into the remaining volume 30 between the spider 27 and the cylinder-inside diameter 24*a*, continuing to compress the gas 28 into a minimum volume not otherwise obtainable. This provides for the maximum driving pressure of the gas 28 through the interrupting region 38 and the insulating nozzle 33. An important feature of the disclosed arrangement is the lake of required orientation between the two mating members 22, 26** during assembly operations, thus avoiding any possible damage during operation due to misalignment.

From the foregoing description it will be apparent that there has been provided an improved puffer-type circuit interrupter 1 in which improved gas-flow conditions are achieved with the minimization of the "dead"

gas volume, or space 30 within the movable operating cylinder 22 at the end of the opening stroke of the interrupter 1. It will be observed that the gas-flow paths are open and unimpeded, passing upwardly past the cluster of movable arcing fingers 48 and through the throat portion 56 of the insulating nozzle 33 where arc-extinction is quickly achieved. Also, it will be observed that the heated gas is cooled by the stationary cluster of main stationary contact fingers 42.

Although there has been illustrated and described a specific structure, it is to be clearly understood that the same was merely for the purpose of illustration, and that changes and modifications may readily be made therein by those skilled in the art, without departing from the spirit and scope of the invention.

We claim:

1. A puffer-type compressed-gas circuit-interrupter adaptable for high-current ratings including means defining a relatively-stationary contact structure, said relatively-stationary contact structure including a cluster of stationary main contact fingers (42) disposed in a generally cylindrical arrangement and a centrally-disposed stationary tubular arcing contact (46), means defining a cooperable movable contact structure (7), a movable operating-cylinder assembly (22) carrying said movable contact structure (7) and also an insulating nozzle, said movable operating-cylinder assembly (22) having disposed thereon adjacent its forward end an annular relatively-heavy movable main contact (44) making cooperable engagement with said cluster of stationary main contact fingers (42) in the closed-circuit position of the circuit-interrupter, means defining a relatively-fixed piston member (26), a movable operating rod (20) for actuating the movable contact structure (7) and extending centrally through said relatively-fixed piston member (26) and guided thereby, said movable operating-cylinder assembly (22) having an elongated skirt portion (24) slidable over said relatively-fixed piston member (26) during the opening operation for gas compression, said movable contact structure (7) additionally carrying a centrally-disposed movable arc horn (54) at its forward end which enters the stationary tubular arcing contact (46) in the closed-circuit position of the device, a cluster of relatively-movable arcing contact fingers (48) surrounding said centrally-disposed movable arc-horn (54) and making separable cotacting engagement with the external side of said centrally-disposed stationary tubular arcing contact (46), and arrangement functioning to first separate the main stationary and movable contacts (42, 44) followed by a subsequent separation of the cluster of relatively-movable arcing contact fingers (48) from the stationary tubular arcing contact (46) and finally a subsequent withdrawal of the arc-horn (54) from the interior of the stationary tubular arcing contact (46), gas being compressed between the movable operating cylinder and the relatively fixed piston being forced out of the movable cylinder assembly through said hollow movable insulating nozzle (33) into engagement with the established arc (34) drawn within the hollow movable nozzle (33) and between the stationary tubular arcing contact (46) and the movable contact probe (54) during the opening operation of the device.

2. The combination according to claim 1, wherein a movable insulating nozzle (33) is relatively short in its axial length and also extends within the cluster of stationary main contact fingers (42) in the closed-circuit position of the device.

3. The combination according to claim 1, wherein the movable insulating nozzle (33) has a plurality of radially outwardly-extending venting holes (36) extending from the restricted throat portion (56) of the hollow movable insulating nozzle (33).

4. The combination according to claim 1, wherein the relatively-fixed piston structure (26) has a centrally-disposed cavity (52) of annular configuration, said movable contact operating rod (20) extending centrally through the fixed piston structure and also centrally through the annular cavity (52) for operating the movable operating cylinder assembly (22), and the movable operating-cylinder assembly having an enlarged movable mating boss portion (50) which enters said stationary cavity (52) in complementary fashion during the opening operation of the circuit-interrupter to minimize the "dead" volume of gas between the movable operating cylinder and the relatively-fixed piston at the end of the opening operation of the device.

5. The combination according to claim 1, wherein a plurality of sliding ring-shaped contacts (9) are supported by the fixed piston structure (26) and bear upon the side of the movable contact operating rod (20) to carry current thereto.

6. The combination according to claim 4, wherein the annular cavity (52) and the enlarged projecting boss-portion (50) have no axially-orientated discontinuities, so that there may be free relative rotative motion therebetween and consequently no alignment procedures therebetween are required during the manufacturing assembly operations of the interrupter.

7. The combination according to claim 1, wherein the movable arc horn (54) has a threaded connection with the upper end of the movable contact operating rod (20) and additionally clamps into proper position the cluster of movable arcing contact fingers (48) into an operable contacting position with respect to the movable operating cylinder assembly (22) having the tip portion of the arcing horn (54) projecting into the interior of the insulating hollow movable nozzle (33) on the upstream side of the throat restriction (56) of the movable nozzle.

8. The combination in a puffer- type compressed-gas circuit-interrupter of a movable operating-cylinder assembly (22) including a hollow insulating nozzle and an enlarged boss portion (50) constituting a reverse-bend constructional configuration of the movable operating cylinder assembly (22), means defining a relatively-fixed piston structure (26) over which the movable operating cylinder assembly (22) slides during the opening operation, said fixed piston structure (26) defining a centrally-disposed annular cavity (52), a conducting movable contact-operating rod (20) passing centrally through the fixed piston structure (26) and also centrally through said annular stationary cavity (52), said enlarged boss portion (50) fitting closely within said cavity (52) in the fully-open circuit position of the puffer-type circuit-interrupter in complementary fashion, and the construction being such that a very tight fit and close engagement of the fixed piston structure (26) and the movable operating cylinder (22) adjacent the reverse-bend portion (50) thereof occurs at the end of the opening operation of the device to thereby minimize dead gas volume between the movable operating cylinder assembly (22) and the fixed piston structure (26).

* * * * *